US011536117B2

(12) United States Patent
Granville et al.

(10) Patent No.: US 11,536,117 B2
(45) Date of Patent: Dec. 27, 2022

(54) MONITORING FLUID CHARACTERISTICS DOWNHOLE

(71) Applicant: HALLIBURTON ENERGY SERVICES, INC., Houston, TX (US)

(72) Inventors: John Philip Granville, Humble, TX (US); Etienne Samson, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 635 days.

(21) Appl. No.: 16/491,980

(22) PCT Filed: Oct. 8, 2018

(86) PCT No.: PCT/US2018/054858
§ 371 (c)(1),
(2) Date: Sep. 6, 2019

(87) PCT Pub. No.: WO2020/076286
PCT Pub. Date: Apr. 16, 2020

(65) Prior Publication Data

US 2020/0109612 A1 Apr. 9, 2020

(51) Int. Cl.
*E21B 43/02* (2006.01)
*E21B 43/12* (2006.01)
*E21B 47/18* (2012.01)

(52) U.S. Cl.
CPC ..... *E21B 43/025* (2013.01); *E21B 43/12* (2013.01); *E21B 47/18* (2013.01)

(58) Field of Classification Search
CPC ..... E21B 43/025; E21B 43/12; E21B 47/18; E21B 47/107
See application file for complete search history.

(56) References Cited

U.S. PATENT DOCUMENTS 6,531,694 B2 3/2003 Johnson et al.
9,784,862 B2 10/2017 Childers et al.
(Continued)

FOREIGN PATENT DOCUMENTS

WO 9309405 A1 5/1993
WO 2017174746 A1 10/2017

OTHER PUBLICATIONS

PCT/US2018/054858, "International Search Report and Written Opinion", dated Jul. 8, 2019, 11 pages.

*Primary Examiner* — Abby J Flynn
*Assistant Examiner* — Yanick A Akaragwe
(74) *Attorney, Agent, or Firm* — Kilpatrick Townsend & Stockton LLP

(57) ABSTRACT

Fluid characteristics of a well fluid can be monitored. For example, a computing device can receive sensor signals from an acoustic sensor positioned on a well tool. The sensor signals can indicate characteristics of acoustic emissions generated by a well fluid impacting the well tool. The computing device can determine an acoustic signature for the well fluid using the characteristics of the acoustic emissions. The computing device can determine a difference between the acoustic signature a baseline acoustic-signature for the well fluid. The computing device can determine one or more fluid characteristics of the well fluid using the difference between the acoustic signature and the baseline acoustic-signature. The computing device can transmit a notification indicating the one or more fluid characteristics.

20 Claims, 8 Drawing Sheets

(56) References Cited

U.S. PATENT DOCUMENTS

| | | | | |
|---|---|---|---|---|
| 2003/0085038 | A1 | 5/2003 | Restarick et al. | |
| 2007/0047867 | A1* | 3/2007 | Goldner | E21B 47/107 385/12 |
| 2009/0294128 | A1 | 12/2009 | Dale et al. | |
| 2018/0120865 | A1 | 5/2018 | Nuryaningsih et al. | |
| 2020/0200000 | A1* | 6/2020 | Langnes | E21B 47/135 |

* cited by examiner

MONITORING FLUID CHARACTERISTICS DOWNHOLE

TECHNICAL FIELD

The present disclosure relates generally to devices for use in a wellbore. More specifically, but not by way of limitation, this disclosure relates to monitoring fluid characteristics downhole.

BACKGROUND

A well system can include a wellbore drilled through a subterranean formation for extracting a target fluid (e.g., oil or gas) from the subterranean formation. Production tubing and well tools can be installed in the wellbore to enable the target fluid to be produced from the subterranean formation.

One example of a well tool typically installed in a wellbore is a sand control device. The sand control device can be positioned between the subterranean formation and the production tubing. The sand control device can include a sand screen for filtering sand (and other solid particles) from the target fluid, before the target fluid enters the production tubing. A gravel pack can also be positioned between the subterranean formation and the sand control device, so that the target fluid travels through both the gravel pack and the sand control device, improving sanding filtration.

Sand control devices can be damaged due to high stress, erosion, and other factors. For example, a sand screen can gradually wear over time due to repeated impacts from sand and rocks. The damage can reduce the effectiveness of the sand control device, resulting in undesirable concentrations of sand remaining in the target fluid as it enters the production tubing. The sand can damage the production tubing, reduce the quality of the target fluid produced from the wellbore, and present a variety of other problems that can be expensive, time consuming, and challenging to remedy.

DETAILED DESCRIPTION

Figure 1:
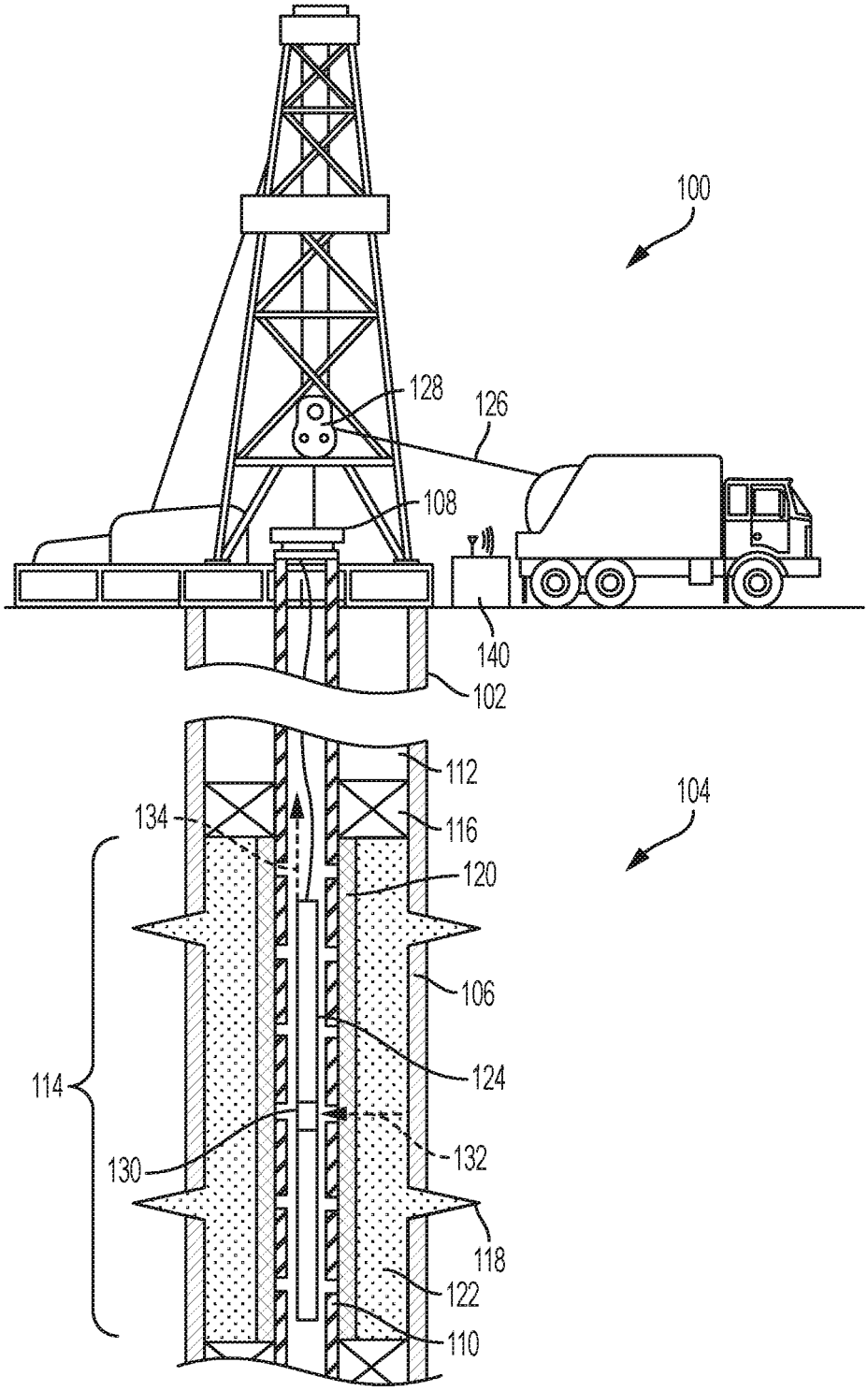
FIG. 1 is a cross-sectional side view of an example of a well system according to some aspects.

Certain aspects and features of the present disclosure relate to monitoring fluid characteristics downhole using a well tool with an acoustic sensor, such as a hydrophone. The acoustic sensor can detect acoustic emissions associated with the well fluid, such as acoustic emissions generated by the well fluid impacting the acoustic sensor. The characteristics (e.g., amplitudes, frequencies, and phases) of the acoustic emissions can be related to various fluid characteristics, such as the sand concentration in the well fluid, the flow velocity of the well fluid, the volumetric flow rate of the well fluid, and the viscosity of the well fluid. The acoustic sensor can transmit sensor signals indicating the characteristics of the acoustic emissions to a computing device. The computing device can receive the sensor signals and compare the characteristics of the acoustic emissions to baseline values to determine a difference between the two. The baseline values may have been previously obtained using the acoustic sensor (e.g., when the well fluid had little or no sand). The difference between the characteristics of the acoustic emissions and the baseline values can indicate one or more of the fluid characteristics. After determining the one or more fluid characteristics, the computing device can transmit a notification indicating the one or more of the fluid characteristics to a well operator. This can enable the well operator to take preventative or corrective action, if needed.

In some examples, the well tool can include a motion sensor for measuring displacement, velocity, acceleration, or any combination of these. Examples of the motion sensor can include a displacement sensor, a geophone, or an accelerometer. The motion sensor can detect motion generated by the well fluid impacting the well tool. The motion sensor can transmit the characteristics of the motion to the computing device. The characteristics of the motion can also be related to the fluid characteristics of the well fluid. For example, vibration amplitudes, phases, and frequencies can be proportional to the sand concentration, flow velocity, and flow rate of the well fluid. The computing device can receive the characteristics of the motion from the motion sensor and compare them to baseline values to determine a difference between the two. For example, the computing device can receive vibration amplitudes and compare them to baseline amplitudes to determine a difference between the two. The baseline values may have been previously obtained using the motion sensor (e.g., when the well fluid had little or no sand). The difference between the characteristics of the motion and the baseline values can indicate one or more fluid characteristics. In some examples, the computing device can confirm that a fluid-characteristic value (e.g., sand-concentration level) determined using the acoustic sensor is accurate if it is within a predefined tolerance range (e.g., 2%) of the fluid-characteristic value determined using the motion sensor, or vice-versa. This can improve reliability. The motion sensor can also provide redundancy, should the acoustic sensor fail.

In some examples, the motion sensor is a three-axis accelerometer capable of distinguishing vibrations along three perpendicular axes of motion: an X-axis, a Y-axis, and a Z-axis. The computing device can use information from the three-axis accelerometer to distinguish between motion from well fluid flowing in a direction perpendicular to the well tool and motion from another fluid flowing in a direction parallel to the well tool. For example, the well tool can be positioned in a production tubing in the wellbore. The computing device can use information from the three-axis accelerometer to distinguish between (i) vibrations from well fluid leaking through an orifice adjacent to the well tool and flowing in the direction perpendicular to the well tool, and (ii) vibrations from production fluid flowing through the production tubing in the direction parallel to the well tool from locations downhole. The computing device can then filter out (or ignore) the vibrations from the production fluid in order to determine the fluid characteristics of the well fluid leaking through the orifice. This can enable the computing device to determine, for example, how much sand inflow is occurring at a specific location in the wellbore, such as in a particular production-zone or at a particular leak.

In some examples, the well tool can also be used to measure or derive the flow rate of the well fluid flowing in the direction perpendicularly to the well tool. For example, the well tool can include a flow rate sensor. Examples of the flow rate sensor can be an accelerometer (e.g., single axis or multiple axis), a hydrophone, a mechanical spinner, a magnetic spinner, or an ultrasonic flow-rate tool. The flow rate sensor can transmit sensor signals indicating the flow rate of the well fluid to the computing device. The computing device can receive the information and determine whether the flow rate exceeds a predetermined threshold, such as 5 meters per second (m/s). If so, the computing device can transmit an alert indicating a potential problem. As a particular example, the well tool can be positioned adjacent to leak in the production tubing. And the computing device can determine that there is little or no sand in the leaking fluid by analyzing the characteristics of acoustic emissions or motion associated with the leaking fluid (e.g., as discussed above). So, the leak may not present a significant problem for the well operator, yet. But the flow rate sensor may indicate that the leaking fluid is flowing at a high velocity, such as 10 m/s. Because this high velocity will likely lead to a large amount of erosion, the leak will likely expand and have sand inflow in the future. So, the computing device can identify and preemptively warn the well operator of this potential problem. This can enable the well operator to take preventative or corrective action.

In some cases, the well tool may be more accurate if it is positioned near a source of sand inflow (e.g., a leak) in the wellbore. But it can be time consuming and difficult to determine the location of a sand-inflow source in the wellbore, since a wellbore can be thousands of meters long. Some examples of the present disclosure can overcome this issue using a distributed acoustic sensing (DAS) system. The DAS system can include a fiber optic cable running the length of the wellbore. The fiber optic cable can be interrogated to determine the characteristics of acoustic emissions in various zones throughout the wellbore. The characteristics of the acoustic emissions can be compared to baseline values to determine differences between the two. The baseline values may have been previously obtained using the DAS system (e.g., when the wellbore had little or no sand). Zones with differences exceeding a predefined threshold can be flagged as being potentially problematic (e.g., as zones with potential sand-inflow).

By using the DAS system to identify potentially problematic zones in the wellbore, the amount of time required to locate sand-inflow sources can be dramatically reduced. However, because the DAS system is a distributed sensing system, it may not provide the accuracy or resolution of a point source tool, such as an acoustic sensor or motion sensor. So, in some examples, after identifying a potentially problematic zone using the DAS system, the well tool can be used to perform a more specific analysis of well fluid in the zone. In this manner, the DAS system can be used to initially highlight zones of interest, and then the well tool can be used to perform point-source monitoring in a more efficient manner that focuses on the identified zones of interest.

Some examples of the present disclosure can be usable to monitor sand flowing through leaks (e.g., in sand screens and other tubulars). Other examples can be usable to monitor sand in fluid flows in production (or "frac") zones where the rock is fractured and reservoir fluids are flowing through the fractures into the wellbore. In some such examples, the sand may not be from erosion or corrosion, but may instead be from the wellbore itself during production.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional side view of an example of a well system 100 according to some aspects. The well system 100 includes a wellbore 102 extending through a hydrocarbon bearing subterranean formation 104. The wellbore 102 can be vertical, deviated, horizontal, or any combination of these. The wellbore 102 can include a casing string 106. The casing string 106 can provide a conduit through which well fluids, such as production fluids produced from the subterranean formation 104, can travel from the wellbore 102 to the well surface 108.

The wellbore 102 can be divided into one or more production zones, such as production zone 114. The ends of each production zone can be defined by packers 116, which can create fluid seals around the production zone. Each production zone can include one or more perforations 118 to enable a well fluid to flow from the subterranean formation 104 into a tubular 110, such as a production string.

The tubular 110 can have apertures to enable, well fluid to enter the tubular 110. A sand control device 120, such as a sand screen, can surround the apertures to limit sand inflow into the tubular 110. A gravel pack 122 can also be positioned between the sand control device 120 and the casing string 106 to further limit sand inflow into the tubular 110.

The sand control device 120 may become damaged over time due to the harsh downhole conditions, thereby enabling higher concentrations of sand to enter the tubular 110. The higher concentrations of sand can damage various components of the well system 100 and create other problems. So, it can be desirable to monitor the concentration of sand in the well fluid to identify and mitigate any issues.

Some examples of the present disclosure include a well tool 124 for monitoring fluid characteristics downhole. The well tool 124 deployed in the wellbore 102 via a conveyance 126 (e.g., a wireline, slickline, or coiled tube). The conveyance 126 can be guided into the wellbore 102 using a guide 128 or winch.

The well tool 124 can include sensors 130 configured to transmit sensor signals to a computing device 140 via a wired or wireless interface. The computing device 140 can receive the sensor signals and determine the fluid characteristics of the well fluid based on the sensor signals. While the computing device 140 is positioned at the well surface 108 in FIG. 1, in other examples the computing device 140 can be positioned in the well tool 124 or offsite.

Figure 2:
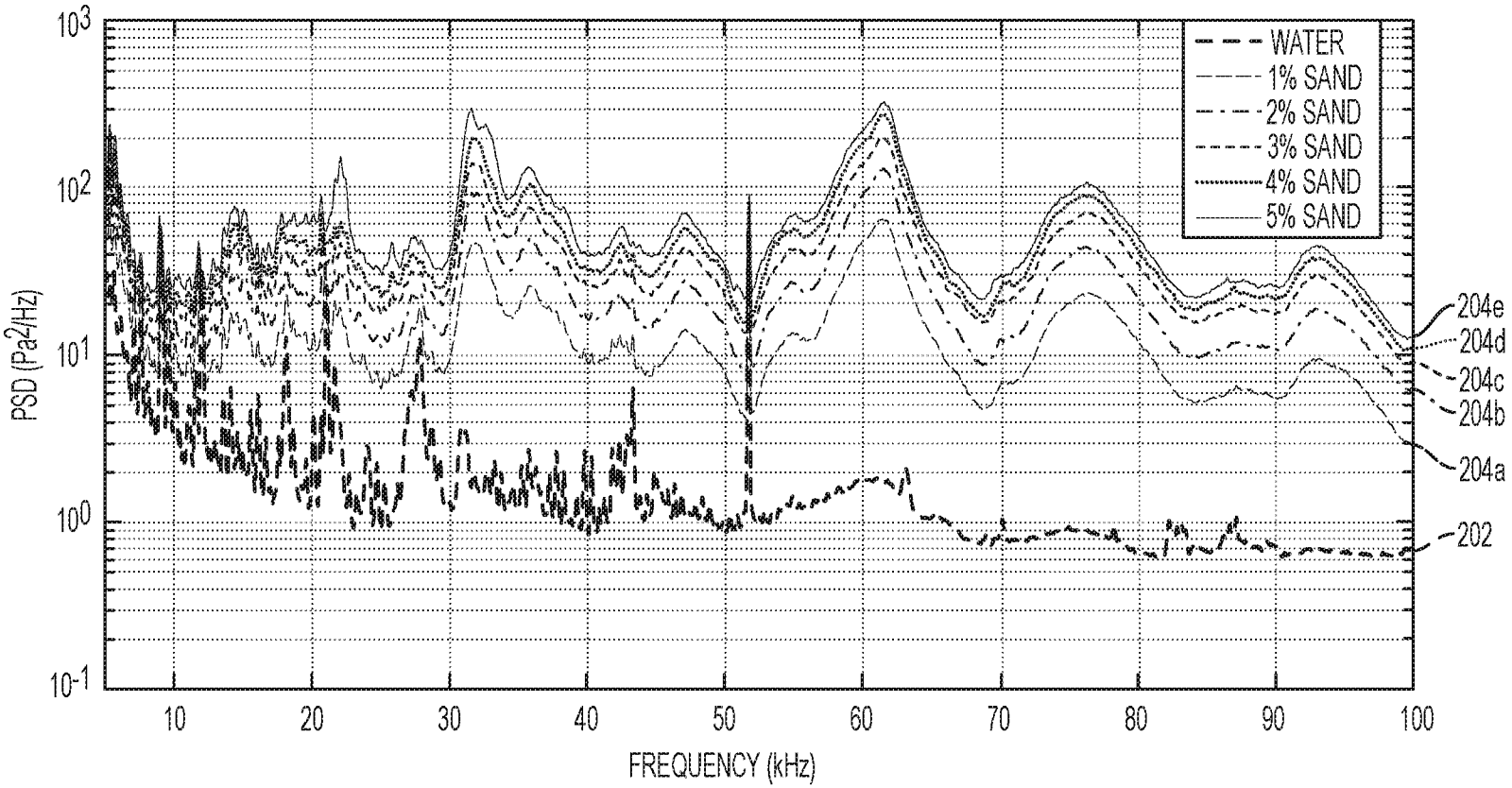
FIG. 2 is a graph of an example of a comparison between an acoustic signature of a fluid without sand and acoustic signatures of the fluid with sand according to some aspects.

The sensors 130 may include any number and combination of acoustic sensors, such as microphones and or hydrophones. The acoustic sensor(s) can detect acoustic emissions associated with a well fluid. The well fluid can be flowing in a direction perpendicular to the well tool 124, as shown by dashed arrow 132. The acoustic emissions can be generated by the well fluid impacting the well tool 124 (e.g., the acoustic sensor on the well tool 124). The characteristics of the acoustic emissions can be related to the fluid characteristics of the well fluid. For example, as the amount of sand present in the well fluid increases, the amplitudes and dominant frequencies of the acoustic emissions can also increase. And as the amount of sand present in the well fluid decreases, the amplitudes and dominant frequencies of the acoustic emission can also decrease. An example of this phenomenon is shown in FIG. 2. In FIG. 2, the power spectral density (PSD) of acoustic emissions resulting from pure water (no sand) is shown by line 202. And the power spectral densities of acoustic emissions resulting from well fluids having various combinations of water and sand are shown by lines 204*a-e*. For example, line 204*a* corresponds to a well fluid having water and 1% sand. Line 204*b* corresponds to a well fluid having water and 2% sand. Line 204*c* corresponds to a well fluid having water and 3% sand. Line 204*d* corresponds to a well fluid having water and 4% sand. Line 204*e* corresponds to a well fluid having water and 5% sand. The differences between the power spectral densities can be more pronounced at higher frequencies. For example, the differences between line 202 and lines 204*a-e* are more pronounced between 60 kHz and 100 kHz, and can be even more evident at frequencies of 1 MHz or more.

In some examples, the computing device 140 can receive the characteristics of the acoustic emissions from the acoustic sensor(s) and use the characteristics to form an acoustic signature for the well fluid. The acoustic signature may include a distribution of magnitudes over a range of frequencies, for example, as shown by line 204*a* in FIG. 2. The magnitudes can include the amplitudes of the acoustic emissions, power spectral densities derived from the amplitudes of the acoustic emissions, or other values derived from the amplitudes of the acoustic emissions. The computing device 140 can also determine a baseline acoustic-signature. The baseline acoustic-signature can be an acoustic signature derived from the characteristics of acoustic emissions detected at a prior point in time (e.g., when the well fluid had no sand). An example of the baseline acoustic-signature is shown by line 202 in FIG. 2. The computing device 140 can compare the acoustic signature to the baseline acoustic-signature to determine a difference between the two (e.g., at a particular frequency, such as 65 kHz). Based on the difference, the computing device 140 can determine that the well fluid has certain fluid characteristics, such as a 2% concentration of sand.

Figure 3:
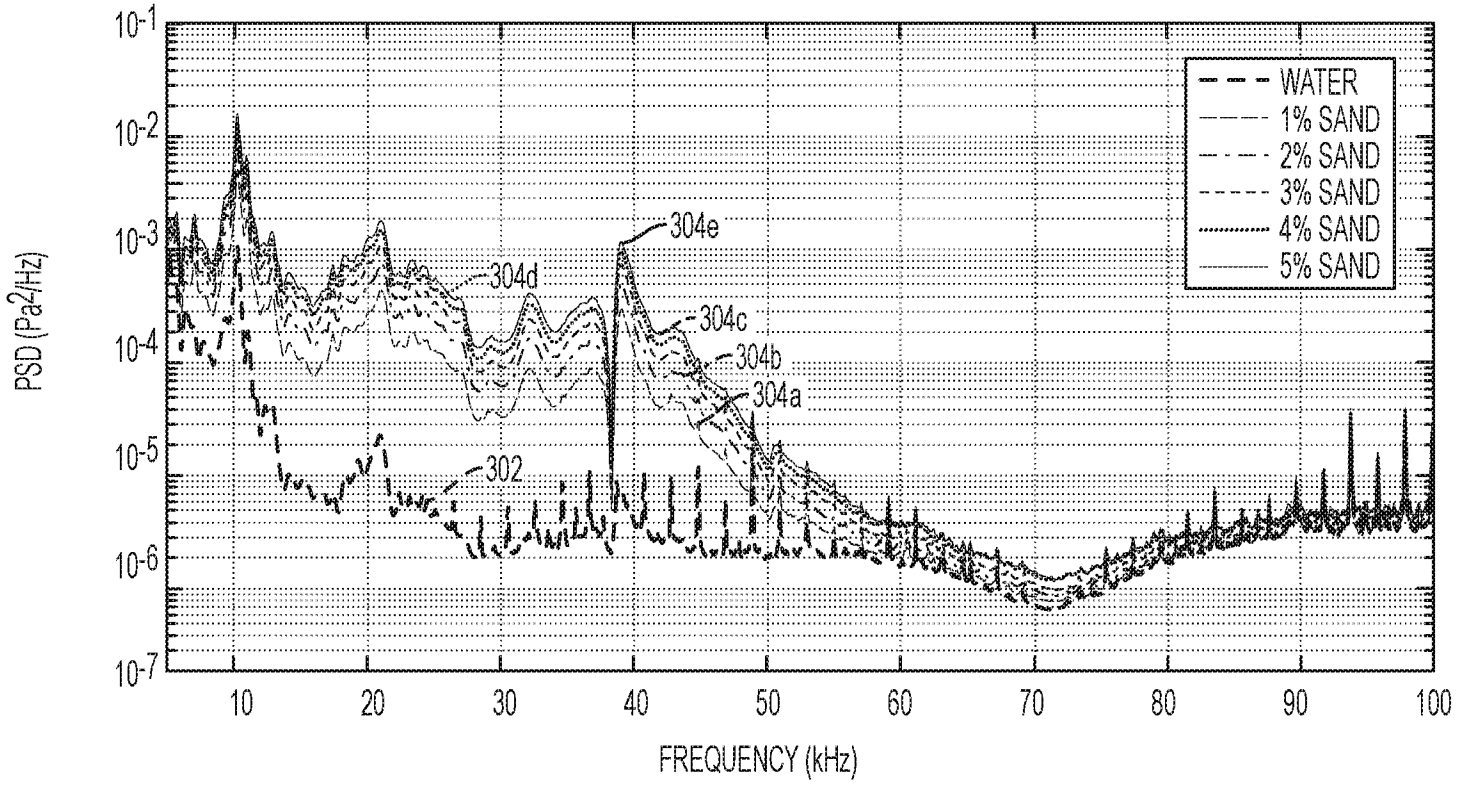
FIG. 3 is a graph of an example of a comparison between a motion signature of a fluid without sand and motion signatures of the fluid with sand according to some aspects.

The sensors 130 may additionally or alternatively include any number and combination of motion sensors, such as accelerometers or geophones. The motion sensor(s) can detect motion associated with the well fluid. The motion can be generated by the well fluid impacting the well tool 124 (e.g., the motion sensor on the well tool 124). The motion can be related to the fluid characteristics of the well fluid, such as the concentration of sand in the well fluid and the transverse flow-velocity of the sand flow. For example, as the amount of sand present in the well fluid increases, the amplitudes and dominant frequencies of vibrations detected by the motion sensor can also increase. And as the amount of sand present in the well fluid decreases, the amplitudes and dominant frequencies of the vibrations can also decrease. An example of this phenomenon is shown in FIG. 3. In FIG. 3, the power spectral density of vibrations resulting from pure water (no sand) is shown by line 302. And the power spectral densities of vibrations resulting from well fluids having various combinations of water and sand are shown by lines 304*a-e*. For example, line 304*a* corresponds to a well fluid having water and 1% sand. Line 304*b* corresponds to a well fluid having water and 2% sand. Line 304*c* corresponds to a well fluid having water and 3% sand. Line 304*d* corresponds to a well fluid having water and 4% sand. Line 304*e* corresponds to a well fluid having water and 5% sand. The differences between the power spectral densities can be more pronounced at mid-range frequencies. For example, the differences between line 302 and lines 304*a-e* are more pronounced between 15 kHz and 40 kHz.

In some examples, the computing device 140 can receive the characteristics of the motion from the motion sensor(s) and use the characteristics of the motion to form a motion signature for the well fluid. A motion signature may include a distribution of magnitudes over a range of frequencies, for example, as shown by line 304*a* in FIG. 3. The magnitudes can include the amplitudes of the motion (e.g., vibration amplitudes), power spectral densities derived from the amplitudes of the motion, or other values derived from the amplitudes of the motion. In some examples, the vibration sensor is a three-axis accelerometer. The computing device 140 can use information from the three-axis accelerometer to distinguish between (i) motion from well fluid flowing in a direction perpendicular to the well tool 124 (e.g., as shown by dashed arrow 132), and (ii) motion from another fluid flowing in a direction parallel to the well tool 124 as shown by dashed arrow 134). The computing device 140 can then use the characteristics of the motion resulting from the well fluid flowing in the direction perpendicular to the well tool 124 to determine the motion signature. After determining the motion signature, the computing device 140 can compare the motion signature to a baseline motion-signature to determine a difference between the two (e.g., at a particular frequency, such as 25 kHz). The baseline motion-signature can be a motion signature derived from the characteristics of motion detected at a prior point in time, for example, as shown by line 302 in FIG. 3. Based on the difference, the computing device 140 can determine that the well fluid has certain fluid characteristics, such as a 3% concentration of sand.

As mentioned above, in some examples the computing device 140 can determine the concentration of sand in the well fluid based on the characteristics of the acoustic emissions or motion detected by the sensors 130. But the characteristics of the acoustic emissions and motion can depend on the fluid characteristics (e.g., the flow rate or viscosity) of the well fluid. So, the computing device 140 may take the fluid characteristics of the well fluid into account in order to more accurately determine the concentration of sand in the well fluid. For example, the computing device 140 can include a database with relationships between (i) fluid characteristics of well fluids, and (ii) baseline signatures (e.g., baseline acoustic-signatures, baseline motion-signatures, or both). The computing device 140 can select, from the database, an appropriate baseline signature that corresponds to fluid characteristics of the well fluid. The computing device 140 can then use this baseline signature for comparison against an acoustic signature, motion signature, or both, in order to determine the concentration of sand in the well fluid. The computing device 140 can determine the fluid characteristics of the well fluid as discussed below, in some examples.

The computing device 140 can determine the fluid characteristics of the well fluid using one or more sensors, which can be included in the sensors 130 or separate from the sensors 130 (e.g., positioned on another well tool). For example, the computing device 140 can determine fluid content, viscosity, or both of the well fluid using one or more sensors configured to detect a pressure, volume, temperature, resistivity, fluid density, capacitance, or any combination of these, of the well fluid. The sensors can be positioned in the wellbore. The computing device 140 can receive sensor signals from the sensors and determine the fluid characteristics of the well fluid based on the sensor signals. For example, the computing device 140 can receive sensor signals from a resistivity sensor indicating the resistivity of the well fluid, and use the resistivity to determine a ratio of a fluid component (e.g., water) to another fluid component (e.g., oil) in the well fluid. The computing device 140 can then use an algorithm or a lookup table to determine the viscosity of the well fluid based on the ratio. The lookup table can include relationships between fluid-component ratios and viscosities. As another example, the computing device 140 can determine the flow rate of the well fluid using a flow-rate sensor positioned on the well tool 124 or another well tool. The flow-rate sensor can be oriented to receive the well fluid flowing in the direction perpendicular to the well tool 124. The flow-rate sensor can transmit sensor signals associated with the well fluid flowing in the directed perpendicular to the well tool 124 to the computing device 140. The computing device 140 can receive the sensor signals and determine the flow rate of the well fluid based on the sensor signals.

The concentration of sand in the well fluid determined using the abovementioned techniques may be a relative amount. For example, the computing device 140 may determine that a well fluid has 5% more sand than a well fluid used to create a baseline signature. But without knowing how much sand was in the well fluid used to create the baseline signature, it may be challenging to determine an absolute amount of sand present in the well fluid. Some examples of the present disclosure can enable an absolute concentration of sand in the well fluid to be determined.

For example, the absolute concentration of sand in a production fluid at the well surface 108 can be determined (e.g., using physical sampling of the production fluid). This can be referred to as the total concentration of sand in the production fluid, since it will include all of the sand contributed by all of the sand inflow downhole. One example of the total concentration of sand in the production fluid can be 5%. Also, a baseline signature can be created using the production fluid at the well surface 108. The computing device 140 can then compare a signature (e.g., an acoustic or motion signature) associated with a well fluid leaking downhole to the baseline signature to determine a magnitude ratio between the two. For example, the computing device 140 can determine that the signature has magnitudes that are 60% of the size of the magnitudes recorded from the total concentration of sand at the well surface 108. Based on the magnitude ratio and the total concentration of sand in the production fluid, the computing device 140 can determine an absolute concentration of sand in the well fluid leaking downhole. For example, the computing device 140 can determine that the well fluid leaking downhole has 3% sand (e.g., 60% of 5% total sand concentration=3% sand).

In some examples, the well tool 124 can be positioned at one or more locations in the wellbore 102 to detect one or more signal amplitudes (e.g., acoustic amplitudes or vibration amplitudes) associated with background noise. These can be referred to as noise-signal amplitudes. For example, the well tool 124 can be positioned uphole of the production zone 114 for detecting amplitudes of acoustic emissions associated with background noise. The computing device 140 can receive the noise-signal amplitudes and use them to improve the signal-to-noise ratio (SNR) associated with subsequent measurements. For example, the computing device 140 can remove the noise-signal amplitudes from acoustic amplitudes subsequently detected using an acoustic sensor to produce processed acoustic-amplitudes. The processed acoustic-amplitudes may have better SNR characteristics than the unprocessed acoustic-amplitudes. As another example, the computing device 140 can remove the noise-signal amplitudes from motion amplitudes (e.g., vibration amplitudes) subsequently detected using a motion sensor to produce processed motion-amplitudes. The processed motion-amplitudes may have better SNR characteristics than the unprocessed motion-amplitudes.

Figure 4:
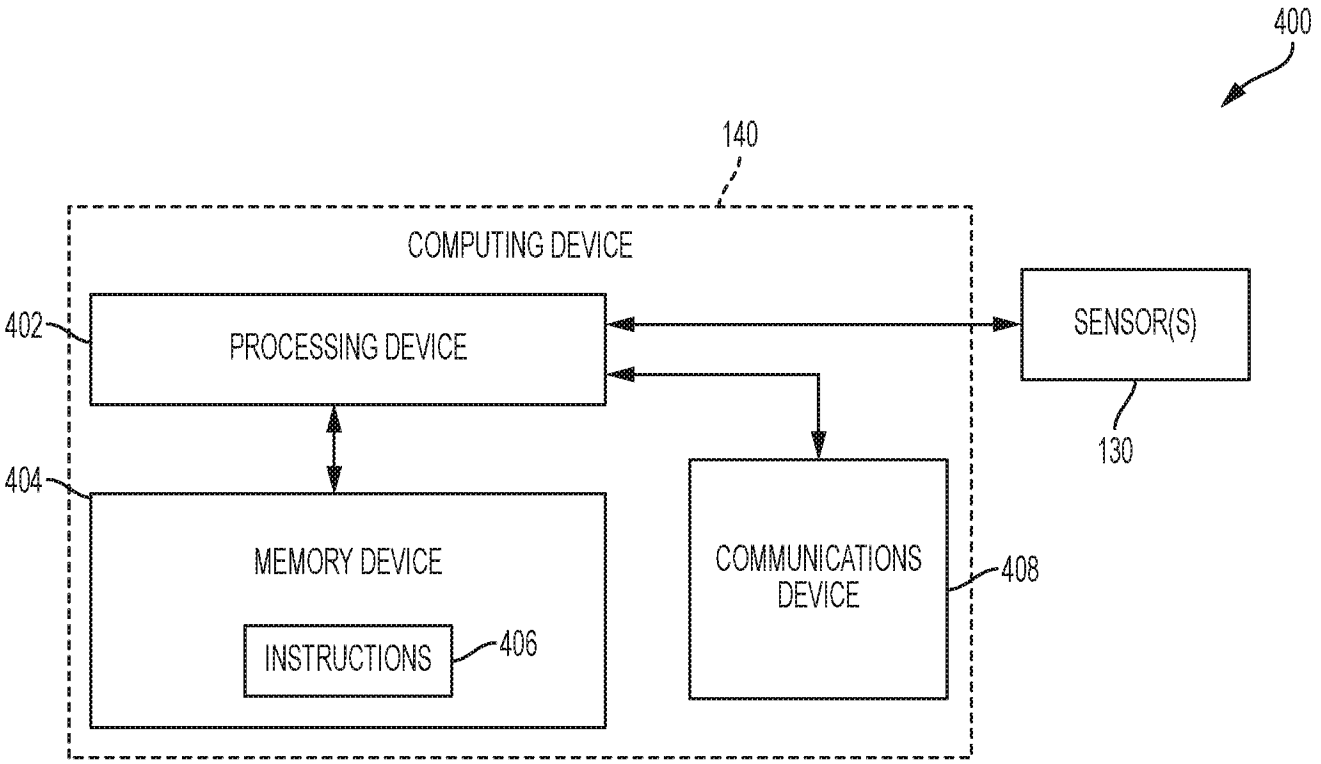
FIG. 4 is a block diagram of an example of a system for monitoring fluid characteristics downhole according to some aspects.

FIG. 4 is a block diagram of an example of a system 400 for fluid characteristics downhole according to some aspects. In some examples, the components of the system 400 can be integrated into a single structure, such as computing device 140. In other examples, the components shown in FIG. 4 can be distributed (e.g., in separate housings) and in electrical communication with each other.

The system 400 can include a processing device 402. The processing device 402 can execute instructions 406 stored in memory device 404 to perform the operations. The processing device 402 can include one processing device or multiple processing devices. Non-limiting examples of the processing device 402 include a Field-Programmable Gate Array ("FPGA"), an application-specific integrated circuit ("ASIC"), a microprocessor, etc.

The processing device 402 can be communicatively coupled to the memory device 404 via a bus. The memory device 404 can be non-volatile and include any type of memory that retains stored information when powered off. Non-limiting examples of the memory device 404 include electrically erasable and programmable read-only memory ("EEPROM"), flash memory, or any other type of non-volatile memory. In some examples, the memory device 404 can include a medium from which the processing device 402 can read the instructions 406. A computer-readable medium can include electronic, optical, magnetic, or other storage devices capable of providing the processing device 402 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions 406. The instructions 406 can include processor-specific instructions generated by a compiler or an interpreter from code written in any suitable computer-programming language, including, for example, C, C++, C#, etc.

The processing device 402 can also be communicatively coupled to a communication device 408. The communication device 408 can represent one or more of any components that facilitate a network connection. The communication device 408 can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication device 408 can use acoustic waves, mud pulses, surface waves, vibrations, optical waves, or induction (e.g., magnetic induction) for engaging in wireless communications. In other examples, the communication device 408 can include wired interfaces such as Ethernet, USB, IEEE 1394, or a fiber optic interface.

The processing device 402 can further be communicatively coupled to one or more sensors 130. Examples of the sensors 130 can include an acoustic sensor, a motion sensor, or both. The sensors 130 can transmit sensor signals to the processing device 402 for monitoring fluid characteristics of a well fluid.

Figure 5:
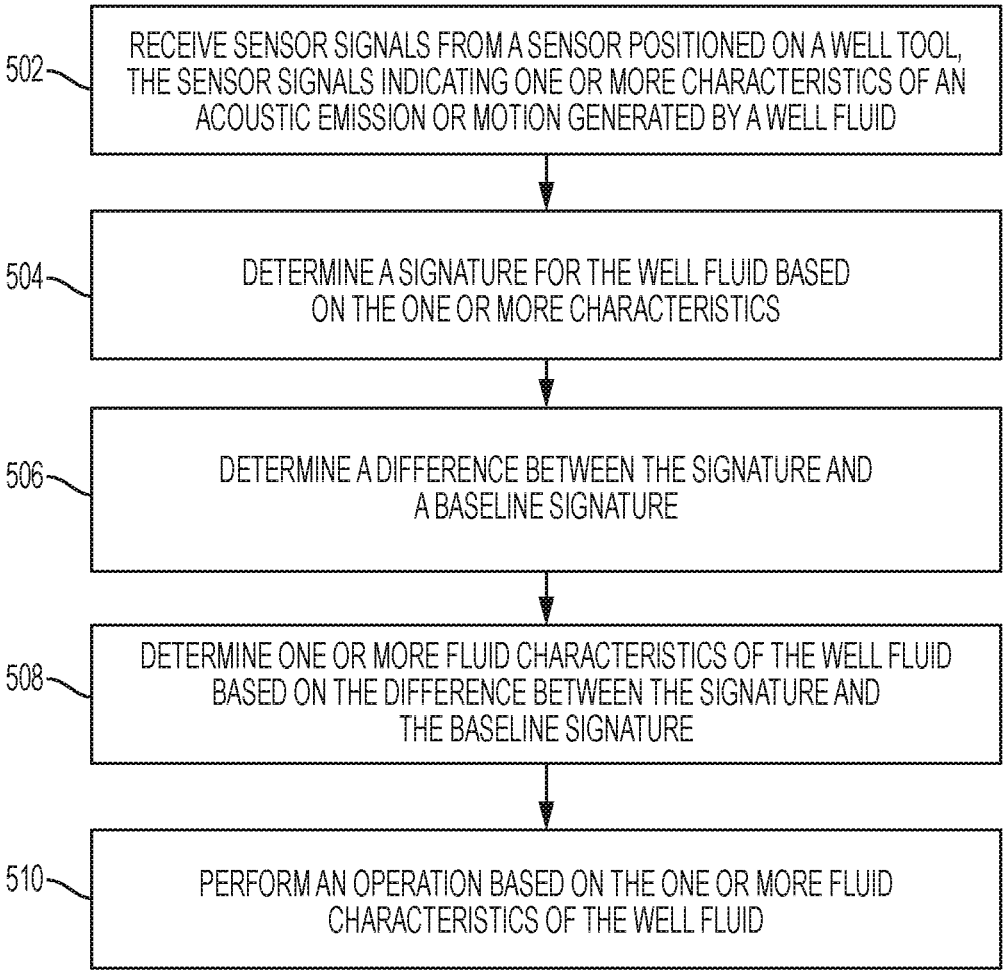
FIG. 5 is a flow chart of an example of a process for fluid characteristics downhole according to some aspects.

In some examples, the processing device 402 can implement some or all of the steps shown in FIG. 5. In other examples, the processing device 402 can implement more steps, fewer steps, different steps, or a different combination of the steps shown in FIG. 5. The steps below are discussed with reference to the components discussed above with respect to FIG. 4.

In block 502, the processing device 402 receives sensor signals from a sensor 130 positioned on a well tool 124. The sensor signals can indicate one or more characteristics (e.g., an amplitude, frequency, phase, or any combination of these) of an acoustic emission or motion generated by a well fluid. For example, the sensor signals can indicate acoustic amplitudes or vibration amplitudes associated with the well fluid impacting the well tool.

In block 504, the processing device 402 determines a signature for the well fluid based on the one or more characteristics. The signature can be an acoustic signature or a motion signature. In some examples, the signature can include a distribution of magnitudes over a period of time. In other examples, the signature can include a distribution of magnitudes over a range of frequencies.

In block 506, the processing device 402 determines a difference between the signature and a baseline signature. The baseline signature can be a baseline acoustic-signature or a baseline motion-signature. In some examples, the baseline signature can include a distribution of magnitudes over a period of time. In other examples, the baseline signature can include a distribution of magnitudes over a range of frequencies. The baseline signature can be generated using the characteristics of acoustic emissions or motion detected by the sensors 130 during a prior time period.

In block 508, the processing device 402 determines one or more fluid characteristics of the well fluid based on the difference between the signature and the baseline signature. One example of a fluid characteristic can be a flow characteristic, such as a flow velocity or volumetric flow rate. Another example of a fluid characteristic can be sand concentration.

As a particular example, the processing device 402 can determine that the signature includes magnitudes that are one quarter of the size of the magnitudes in the baseline signature. So, the processing device 402 can apply a scaling factor of one quarter to a concentration of sand associated with the baseline signature to determine the concentration of sand in the well fluid. As another example, the processing device 402 can use a database that includes relationships between differences and sand concentrations to determine the concentration of sand in the well fluid. For example, the processing device 402 can access the database to determine that a difference of 100 $pa^2/Hz$ correlates to 5% sand concentration. The processing device 402 can use any number and combination of techniques to determine the relative or absolute concentration of sand in the well fluid based on the difference.

In block 510, the processing, device 402 performs an operation based on the one or more fluid characteristics, such as the concentration of sand in the well fluid. The operation can include transmitting a notification (e.g., an alert) associated with the one or more fluid characteristics. In one example, the notification can indicate the numerical concentration of sand in the well fluid.

In some examples, if the concentration of sand in the well fluid is greater than a predefined threshold (e.g., 1%), the processing device 402 can transmit a notification indicating that there is sand present in the well fluid. If the concentration of sand in the well fluid is greater than another predefined threshold (e.g., 10%), the processing device 402 can transmit a notification in the form of an alert indicating that there is a dangerous level of sand present in the well fluid.

In some examples, the processing device 402 can automatically control one or more well tools based on the one or more fluid characteristics. This can help, for example, reduce the amount of sand in the wellbore or the effect of the sand on the well system. As a particular example, the processing device 402 can transmit a control signal to a valve based on the well fluid's sand concentration, flow velocity, or volumetric flow rate exceeding a predefined threshold. The control signal can cause the valve to, for example, redirect or cut off the fluid flow to prevent damage to well equipment. As another example, the processing device 402 can transmit a control signal to a pump based on the concentration of sand in the well fluid exceeding the predefined threshold. The control signal can cause the pump to pump out sand to prevent damage to well equipment.

Figure 6:
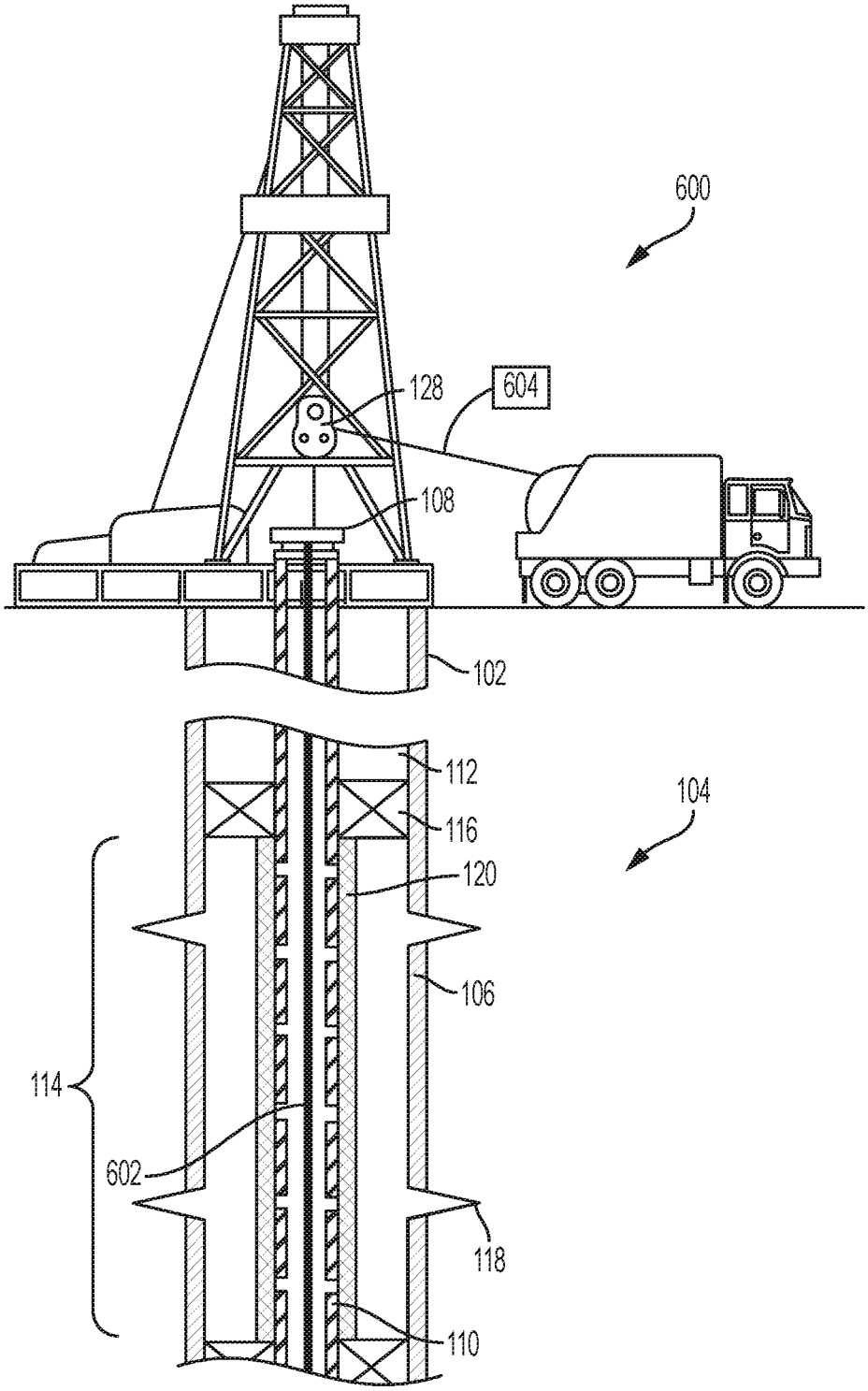
FIG. 6 is a cross-sectional side view of another example of a well system according to some aspects.

FIG. 6 is a cross-sectional side view of another example of a well system 600 according to some aspects. The well system 600 includes a wellbore 102 extending through a hydrocarbon bearing subterranean formation 104. The wellbore 102 can be vertical, deviated, horizontal, or any combination of these. The wellbore 102 can include a casing string 106. The casing string 106 can provide a conduit through which well fluids, such as production fluids produced from the subterranean formation 104, can travel from the wellbore 102 to the well surface 108.

The wellbore 102 can be divided into one or more production zones, such as production zone 114. Each production zone can include one or more perforations 118 to enable a well fluid to flow from the subterranean formation 104 into a tubular 110, such as a production string. The tubular 110 can have apertures to enable well fluid to enter the tubular 110. A sand control device 120, such as a sand screen, can surround the apertures to limit sand inflow into the tubular 110.

The well system 600 also includes a distributed acoustic sensing (DAS) system. The DAS system can be included in, or separate from, the computing device 140 of FIG. 1. The DAS system can include an interrogator 604 (e.g., fiber optic interrogator) and a fiber optic cable 602 positioned downhole. The fiber optic cable 602 can extend through some or all of the length of the wellbore 102 (e.g., via a wireline, slickline, or coiled tubing that includes one or more fiber optic cables). For example, the fiber optic cable 602 can extend through multiple production zones. Although the fiber optic cable 602 is shown in FIG. 6 as being internal to the tubular 110, in other examples the fiber optic cable 602 can be positioned elsewhere in the well system 600. For example, the fiber optic cable 602 can be positioned on the outside of the casing string 106 (e.g., between the casing string 106 and the wellbore 102 or positioned on the outside of the tubular 110).

Figure 7:
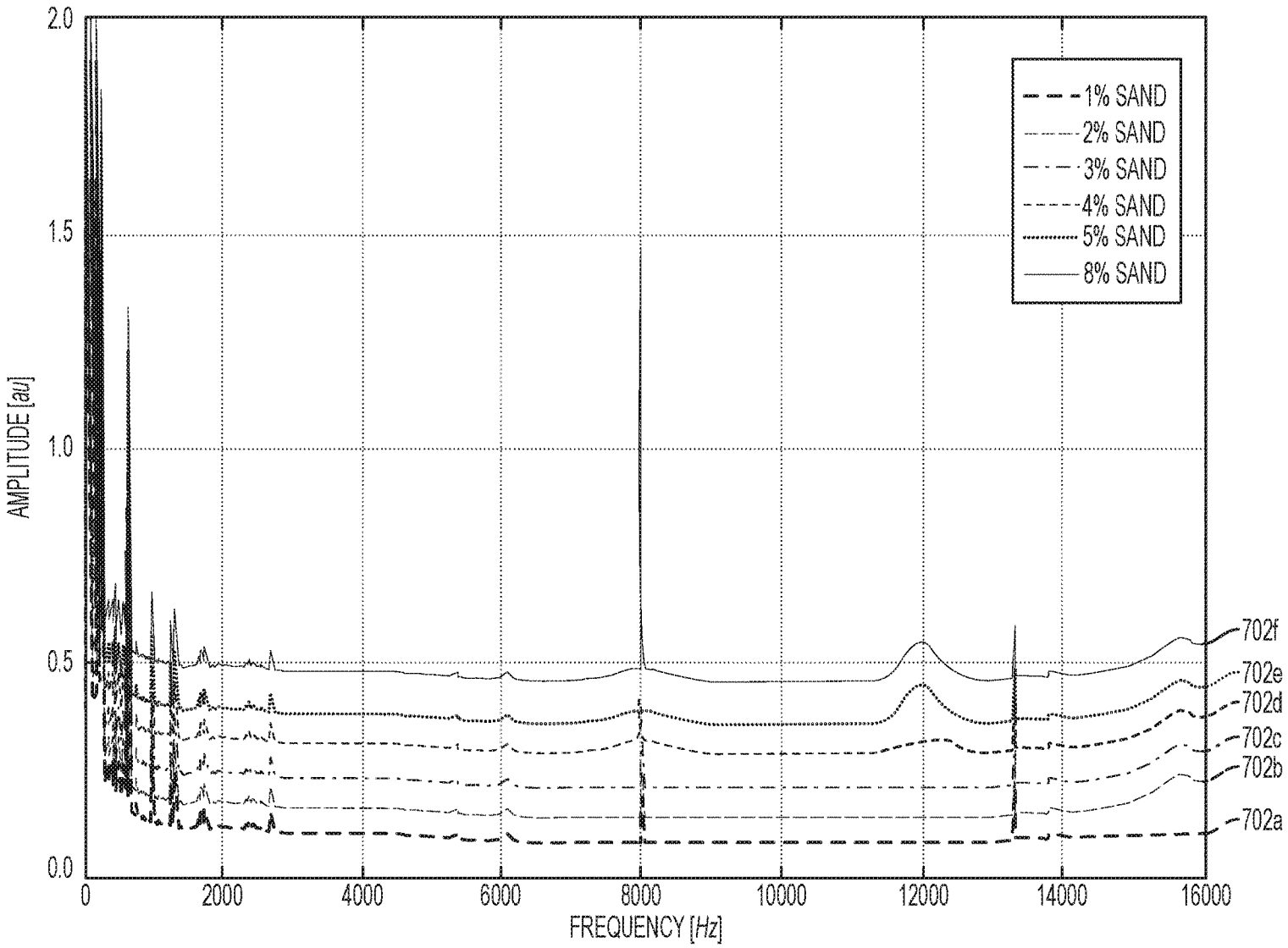
FIG. 7 is a graph of an example of acoustic signatures obtained by a distributed acoustic sensing (DAS) system according to some aspects.

The interrogator 604 can transmit optical signals over the fiber optic cable 602 and receive reflections of the optical signals. The characteristics of the reflections can be affected by the characteristics of acoustic emissions (e.g., waves) impacting the fiber optic cable 602, which in turn can be affected by the concentration of sand in the well fluid that produced the acoustic emissions. An example of this phenomenon is shown in FIG. 7. For example, line 702*a* corresponds to a well fluid having water and 1% sand. Line 702*b* corresponds to a well fluid having water and 2% sand. Line 702*c* corresponds to a well fluid having water and 3% sand. Line 702*d* corresponds to a well fluid having water and 4% sand. Line 702*e* corresponds to a well fluid having water and 5% sand. And line 702*f* corresponds to a well fluid having water and 8% sand. As shown, higher concentrations of sand in the well fluid can result in higher-amplitude reflections detected by the DAS system. In some examples, the DAS system can flag zones with higher concentrations of sand as potentially problematic. In this manner, the DAS system can be used to automatically identify potentially problematic zones in the wellbore 102. This can significantly reduce the amount of time required to manually identify such zones.

After identifying a potentially problematic zone using the DAS system, a well tool (e.g., well tool 124 discussed with respect to FIG. 1) can be positioned in the zone to analyze the well fluid in the zone. By using this two-part approach, the DAS system can first generally identify one or more regions that are potentially problematic in the wellbore 102. These regions can then be further analyzed using the well tool to obtain a more specific, granular level of detail.

Figure 8:
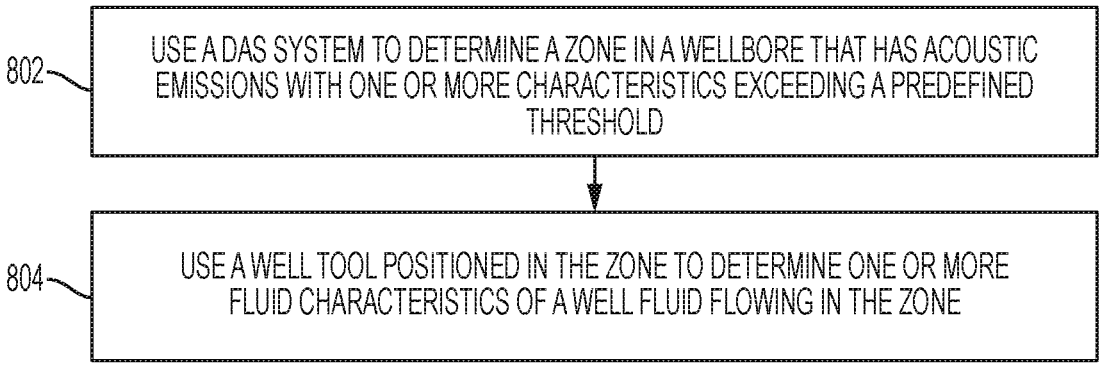
FIG. 8 is a flow chart of an example of a process for monitoring fluid characteristics downhole according to some aspects.

FIG. 8 is a flow chart of an example of a process for monitoring fluid characteristics downhole according to some aspects. Other examples can include more steps, fewer steps, different steps, or a different combination of the steps shown in FIG. 8. The steps below are discussed with reference to the components discussed above with respect to FIGS. 1 and 6.

In block 802, a DAS system is used to determine a zone (or zones) in a wellbore 102 that has acoustic emissions with one or more characteristics (e.g., amplitudes) that exceed a predefined threshold. This may be achieved by analyzing one or more characteristics of acoustic emissions over a large section of the wellbore 102 using the DAS system and flagging at least one zone in which the one or more characteristics exceed the predefined threshold.

For example, an interrogator 604 can transmit optical signals over a fiber optic cable 602 positioned in a wellbore 102 and receive reflections of the optical signals over the fiber optic cable 602. The reflections can indicate the amplitudes of the acoustic emissions in the various zones of the wellbore 102. The interrogator 606 can then flag a zone in the wellbore 102 as having reflections that exceed a predefined reflection-threshold, which can be associated with the predefined threshold for the acoustic-emission characteristics.

In block 804, a well tool 124 positioned in the zone is used to determine one or more fluid characteristics (e.g., a concentration of sand) of a well fluid flowing in the zone. For example, the well tool 124 can implement some or all of the steps of FIG. 5 to determine the concentration of sand in the well fluid.

In some examples, the DAS system can be positioned in the wellbore 102 at the same time as the well tool 124. For example, if the DAS system is deployed in the wellbore 102 on a wireline (e.g., freestanding and not permanently deployed), the fiber optic cable 602 could be run in conjunction with the well tool 124. Running the two together can save on time and costs (e.g., as opposed to performing two separate runs).

In some aspects, fluid characteristics can be monitored according to one or more of the following examples.

Example #1: A system can include an acoustic sensor configured to detect characteristics of acoustic emissions generated by a well fluid impacting a well tool and transmit sensor signals associated with the acoustic emissions. The system can include a processing device in communication with the acoustic sensor. The system can include a memory device including instructions that are executable by the processing device for causing the processing device to perform one or more operations. The operations can include receiving the sensor signals from the acoustic sensor. The operations can include generating an acoustic signature for the well fluid using the characteristics of the acoustic emissions. The operations can include determining a difference between the acoustic signature and a baseline acoustic-signature for the well fluid. The baseline acoustic-signature can indicate other characteristics of other acoustic emissions generated by the well fluid. The operations can include determining a concentration of sand in the well fluid using the difference between the acoustic signature and the baseline acoustic-signature. The operations can include transmitting a notification associated with the concentration of sand in the well fluid in response to the concentration of sand exceeding a predefined threshold.

Example #2: The system of Example #1 may feature a motion sensor configured to detect characteristics of motion resulting from the well fluid impacting the well tool and transmit a plurality of sensor signals to the processing device.

Example #3: The system of any of Examples #1-2 may feature the concentration of sand being a first concentration of sand. The memory device can further include instructions that are executable by the processing device for causing the processing device to receive the plurality of sensor signals from the motion sensor. The instructions can cause the processing device to generate a motion signature for the well fluid using the characteristics of the motion. The instructions can cause the processing device to determine a difference between the motion signature and a baseline motion-signature associated with the well fluid. The instructions can cause the processing device to determine a second concentration of sand in the well fluid using the difference between the motion signature and the baseline motion-signature. The instructions can cause the processing device to determine that the first concentration of sand is accurate in response to the first concentration being within a predefined tolerance range of the second concentration of sand.

Example #4: The system of any of Examples #1-3 may feature the motion sensor being a three-axis accelerometer positioned on the well tool. The memory device cab further include instructions that are executable by the processing device for causing the processing device to distinguish between (i) first motion from a production fluid that is flowing in a direction parallel to the well tool, and (ii) second motion from the well fluid flowing perpendicularly to the well tool, by analyzing the plurality of sensor signals from the three-axis accelerometer.

Example #5: The system of any of Examples #1-4 may feature the memory device further including instructions that are executable by the processing device for causing the processing device to generate a motion signature for the well fluid using amplitudes of the second motion. The instructions can cause the processing device to determine a difference between the motion signature and a baseline motion-signature associated with the well fluid. The instructions can cause the processing device to determine a second concentration of sand in the well fluid using the difference between the motion signature and the baseline motion-signature.

Example #6: The system of any of Examples #1-5 may feature the memory device further including instructions that are executable by the processing device for causing the processing device to determine a flow rate of the well fluid using a flow-rate sensor. The instructions can cause the processing device to determine that the flow rate of the well fluid exceeds a predetermined threshold. The instructions can cause the processing device to transmit an alert indicating a potential problem in response to determining that the flow rate of the well fluid exceeds the predetermined threshold.

Example #7: The system of Example #6 may feature the flow-rate sensor being the acoustic sensor or the motion sensor.

Example #8: The system of any of Examples #1-7 may feature the memory device further including instructions that are executable by the processing device for causing the processing device to determine a viscosity of the well fluid. Determining the viscosity of the well fluid can involve receiving a sensor signal from a resistivity sensor. The sensor signal can indicate a resistivity of the well fluid. Determining the viscosity of the well fluid can involve determining a ratio of a first component of the well fluid to a second component of the well fluid based on the resistivity of the well fluid. Determining the viscosity of the well fluid can involve determining the viscosity of the well fluid based on the ratio of the first component to the second component. The instructions can cause the processing device to determine the concentration of sand in the well fluid using the flow rate and the viscosity of the well fluid.

Example #9: The system of any of Examples #1-8 may feature a distributed acoustic sensing (DAS) system that includes (i) a fiber optic cable positionable in a wellbore and (ii) an interrogator coupled to the fiber optic cable for transmitting optical signals over the fiber optic cable. The DAS system can be for detecting a particular zone among a plurality of zones in the wellbore that includes the well fluid. The acoustic sensor can be positioned on the well tool and within the particular zone for detecting the acoustic emissions from the well fluid in the particular zone.

Example #10: A method can include receiving sensor signals from an acoustic sensor positioned on a well tool in a wellbore. The sensor signals can indicate characteristics of acoustic emissions generated by a well fluid impacting the well tool. The method can include generating an acoustic signature for the well fluid using the characteristics of the acoustic emissions. The method can include determining a difference between the acoustic signature a baseline acoustic-signature for the well fluid. The baseline acoustic-signature can indicate other characteristics of other acoustic emissions generated by the well fluid. The method can include determining a concentration of sand in the well fluid using the difference between the acoustic signature and the baseline acoustic-signature. The method can include transmitting a notification associated with the concentration of sand in the well fluid in response to the concentration of sand exceeding a predefined threshold. Some or all of the method steps can be implemented by a processing device.

Example #11: The method of Example #10 may involve the concentration of sand being a first concentration of sand. And the method may include receiving a plurality of sensor signals from a motion sensor. The sensor signals can indicate amplitudes of vibrations resulting from the well fluid impacting the well tool in a direction perpendicular to the well tool. The method may include distinguishing the vibrations from other vibrations resulting from a production fluid flowing in a direction parallel to the well tool by analyzing the plurality of sensor signals. The method may include generating a motion signature for the well fluid using amplitudes of the vibrations resulting from the well fluid impacting the well tool in the direction perpendicular to the well tool. The method may include determining a difference between the motion signature and a baseline motion-signature associated with the well fluid. The method may include determining a second concentration of sand in the well fluid based on the difference between the motion signature and a baseline motion-signature.

Example #12: The method of any of Examples #10-11 may include receiving a sensor signal from a flow-rate sensor. The sensor signal can indicate a flow rate of the well fluid. The method may include determining that the flow rate of the well fluid exceeds a predetermined threshold. The method may include transmitting an alert indicating a potential problem in response to determining that the flow rate of the well fluid exceeds the predetermined threshold.

Example #13: The method of any of Examples #10-12 can include receiving a sensor signal from a resistivity sensor. The sensor signal indicating a resistivity of the well fluid. The method of can include determining a ratio of a first component of the well fluid to a second component of the well fluid based on the resistivity of the well fluid. The method of can include determining a viscosity of the well fluid based on the ratio of the first component to the second component. The method of can include determining the concentration of sand in the well fluid using the viscosity of the well fluid.

Example #14: The method of any of Examples #10-13 can include, prior to determining the concentration of sand in the well fluid, interrogating a fiber optic cable positioned in the wellbore using a distributed acoustic sensing (DAS) system to determine a plurality of amplitudes of acoustic emissions in a plurality of zones in the wellbore. The method can include determining that at least one amplitude in the plurality of amplitudes exceeds a predetermined threshold. The method can include determining that the at least one amplitude corresponds to a particular zone among the plurality of zones in the wellbore. The method can include, in response to determining that the at least one amplitude corresponds to the particular zone, positioning the well tool in the particular zone to determine the concentration of sand in the well fluid. The well fluid can be fluid leaking through an orifice in the particular zone.

Example #15: The method of any of Examples #10-14 can involve the acoustic signature comprising a distribution of magnitudes over a range of frequencies.

Example #16: A non-transitory computer-readable medium comprising program code that is executable by a processing device for causing the processing device to implement the method of any of Examples #10-15.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure. And examples disclosed herein can be combined and rearranged to yield additional examples.

The invention claimed is:

1. A system comprising:

an acoustic sensor configured to detect characteristics of acoustic emissions generated by a well fluid impacting a well tool and transmit sensor signals associated with the acoustic emissions;

a motion sensor configured to detect characteristics of motion resulting from the well fluid impacting the well tool and transmit a plurality of sensor signals associated with the motion;

a processing device in communication with the acoustic sensor; and a memory device including instructions that are executable by the processing device for causing the processing device to:

receive the sensor signals from the acoustic sensor, generate an acoustic signature for the well fluid using the characteristics of the acoustic emissions;

determine a difference between the acoustic signature and a baseline acoustic-signature for the well fluid, the baseline acoustic-signature indicating other characteristics of other acoustic emissions generated by the well fluid;

determine a first concentration of sand in the well fluid using the difference between the acoustic signature and the baseline acoustic-signature;

receive the plurality of sensor signals from the motion sensor;

generate a motion signature for the well fluid using the characteristics of the motion;

determine a difference between the motion signature and a baseline motion-signature associated with the well fluid;

determine a second concentration of sand in the well fluid using the difference between the motion signature and the baseline motion-signature;

determine that the first concentration of sand is accurate in response to the first concentration of sand being within a predefined tolerance range of the second concentration of sand; and transmit a notification associated with the first concentration of sand in the well fluid in response to the first concentration of sand exceeding a predefined threshold.

2. The system of claim 1, wherein the motion sensor is a three-axis accelerometer positioned on the well tool, and wherein the memory device further includes instructions that are executable by the processing device for causing the processing device to distinguish between (i) first motion from a production fluid that is flowing in a direction parallel to the well tool, and (ii) second motion from the well fluid flowing perpendicularly to the well tool, by analyzing the plurality of sensor signals from the three-axis accelerometer.

3. The system of claim 2, wherein the memory device further includes instructions that are executable by the processing device for causing the processing device to:

generate the motion signature for the well fluid using amplitudes of the second motion;

determine a difference between the motion signature and the baseline motion-signature associated with the well fluid; and determine the second concentration of sand in the well fluid using the difference between the motion signature and the baseline motion-signature.

4. The system of claim 1, wherein the memory device further includes instructions that are executable by the processing device for causing the processing device to:

determine a flow rate of the well fluid using a flow-rate sensor;

determine that the flow rate of the well fluid exceeds a predetermined threshold; and transmit an alert indicating a potential problem in response to determining that the flow rate of the well fluid exceeds the predetermined threshold.

5. The system of claim 4, wherein the flow-rate sensor is the acoustic sensor or the motion sensor.

6. The system of claim 4, wherein the memory device further includes instructions that are executable by the processing device for causing the processing device to:

determine a viscosity of the well fluid by:

receiving a sensor signal from a resistivity sensor, the sensor signal indicating a resistivity of the well fluid;

determining a ratio of a first component of the well fluid to a second component of the well fluid based on the resistivity of the well fluid; and determining the viscosity of the well fluid based on the ratio of the first component to the second component; and determine the first concentration of sand in the well fluid using the flow rate and the viscosity of the well fluid.

7. The system of claim 1, further comprising a distributed acoustic sensing (DAS) system that includes (i) a fiber optic cable positionable in a wellbore and (ii) an interrogator coupled to the fiber optic cable for transmitting optical signals over the fiber optic cable, the DAS system being for detecting a particular zone among a plurality of zones in the wellbore that includes the well fluid;

wherein the acoustic sensor is positioned on the well tool and within the particular zone for detecting the acoustic emissions from the well fluid in the particular zone.

8. A method comprising:

receiving, by a processing device, sensor signals from an acoustic sensor positioned on a well tool in a wellbore, the sensor signals indicating characteristics of acoustic emissions generated by a well fluid impacting the well tool;

generating, by the processing device, an acoustic signature for the well fluid using the characteristics of the acoustic emissions;

determining, by the processing device, a difference between the acoustic signature and a baseline acoustic-signature for the well fluid, the baseline acoustic-signature indicating other characteristics of other acoustic emissions generated by the well fluid;

determining, by the processing device, a first concentration of sand in the well fluid using the difference between the acoustic signature and the baseline acoustic-signature;

receiving, by the processing device, a plurality of sensor signals from a motion sensor, the sensor signals indicating amplitudes of vibrations resulting from the well fluid impacting the well tool in a direction perpendicular to the well tool;

distinguishing, by the processing device, the vibrations from other vibrations resulting from a production fluid flowing in a direction parallel to the well tool by analyzing the plurality of sensor signals;

generating, by the processing device, a motion signature for the well fluid using amplitudes of the vibrations resulting from the well fluid impacting the well tool in the direction perpendicular to the well tool;

determining, by the processing device, a difference between the motion signature and a baseline motion-signature associated with the well fluid; and determining, by the processing device, a second concentration of sand in the well fluid based on the difference between the motion signature and the baseline motion-signature;

determining, by the processing device, that the first concentration of sand is accurate in response to the first concentration of sand being within a predefined tolerance range of the second concentration of sand; and transmitting, by the processing device, a notification associated with the first concentration of sand in the well fluid in response to the first concentration of sand exceeding a predefined threshold.

9. The method of claim 8, further comprising:

receiving a sensor signal from a flow-rate sensor, the sensor signal indicating a flow rate of the well fluid;

determining that the flow rate of the well fluid exceeds a predetermined threshold; and transmitting an alert indicating a potential problem in response to determining that the flow rate of the well fluid exceeds the predetermined threshold.

10. The method of claim 9, wherein the flow-rate sensor is the acoustic sensor or the motion sensor.

11. The method of claim 8, further comprising:

receiving a sensor signal from a resistivity sensor, the sensor signal indicating a resistivity of the well fluid;

determining a ratio of a first component of the well fluid to a second component of the well fluid based on the resistivity of the well fluid;

determining a viscosity of the well fluid based on the ratio of the first component to the second component; and determining the first concentration of sand in the well fluid using the viscosity of the well fluid.

12. The method of claim 8, further comprising, prior to determining the first concentration of sand in the well fluid:

interrogating a fiber optic cable positioned in the wellbore using a distributed acoustic sensing (DAS) system to determine a plurality of amplitudes of acoustic emissions in a plurality of zones in the wellbore;

determining that at least one amplitude in the plurality of amplitudes exceeds a predetermined threshold;

determining that the at least one amplitude corresponds to a particular zone among the plurality of zones in the wellbore; and in response to determining that the at least one amplitude corresponds to the particular zone, positioning the well tool in the particular zone to determine the first concentration of sand in the well fluid, the well fluid being fluid leaking through an orifice in the particular zone.

13. The method of claim 8, wherein the acoustic signature comprises a distribution of magnitudes over a range of frequencies.

14. The method of claim 8, wherein the motion sensor is a three-axis accelerometer positioned on the well tool, and wherein the method further comprises:

distinguishing between (i) first motion from the production fluid flowing in the direction parallel to the well tool, and (ii) second motion from the well fluid flowing perpendicularly to the well tool, by analyzing the plurality of sensor signals from the three-axis accelerometer.

15. The method of claim 14, further comprising:

generating the motion signature for the well fluid using amplitudes of the second motion.

16. A non-transitory computer-readable medium comprising, program code that is executable by a processing device for causing the processing device to:

receive sensor signals from an acoustic sensor positioned on a well tool, the sensor signals indicating characteristics of acoustic emissions generated by a well fluid impacting the well tool;

generate an acoustic signature for the well fluid using the characteristics of the acoustic emissions;

determine a difference between the acoustic signature a baseline acoustic-signature for the well fluid, the baseline acoustic-signature indicating other amplitudes of other acoustic emissions generated by the well fluid;

determine a concentration of sand in the well fluid using the difference between the acoustic signature and the baseline acoustic-signature;

receive a sensor signal from a resistivity sensor, the sensor signal indicating a resistivity of the well fluid;

determine a ratio of a first component of the well fluid to a second component of the well fluid based on the resistivity of the well fluid;

determine a viscosity of the well fluid based on the ratio of the first component to the second component; and determine the concentration of sand in the well fluid using the viscosity of the well fluid; and transmit a notification associated with the concentration of sand in the well fluid in response to the concentration of sand exceeding a predefined threshold.

17. The non-transitory computer-readable medium of claim 16, wherein the concentration of sand is a first concentration of sand, and further comprising program code that is executable by the processing device for causing the processing device to:

receive a plurality of sensor signals from a motion sensor, the sensor signals indicating characteristics of vibrations resulting from the well fluid impacting the well tool in a direction perpendicular to the well tool;

distinguish the vibrations from other vibrations resulting from a production fluid flowing in a direction parallel to the well tool by analyzing the plurality of sensor signals;

generate a motion signature for the well fluid using characteristics of the vibrations resulting from the well fluid impacting the well tool in the direction perpendicular to the well tool;

determine a difference between the motion signature and a baseline motion-signature associated with the well fluid; and determine a second concentration of sand in the well fluid based on the difference between the motion signature and the baseline motion-signature.

18. The non-transitory computer-readable medium of claim 17, wherein the motion sensor is a three-axis accelerometer positioned on the well tool, and further comprising program code that is executable by the processing device for causing the processing device to distinguish between (i) first motion from the production fluid flowing in the direction parallel to the well tool, and (ii) second motion from the well fluid flowing perpendicularly to the well tool, by analyzing the plurality of sensor signals from the three-axis accelerometer.

19. The non-transitory computer-readable medium of claim 16, further comprising program code that is executable by the processing device for causing the processing device to:

receive a sensor signal from a flow rate sensor, the sensor signal indicating a flow rate of the well fluid;

determine that the flow rate of the well fluid exceeds a predetermined threshold; and transmit an alert indicating a potential problem in response to determining that the flow rate of the well fluid exceeds the predetermined threshold.

20. The non-transitory computer-readable medium of claim 16, wherein the acoustic signature comprises a distribution of first magnitudes over a range of frequencies, and the baseline acoustic-signature comprises another distribution of second magnitudes over the range of frequencies, the baseline acoustic-signature is generated using a production fluid at a surface of a wellbore, and further comprising program code that is executable by the processing device for causing the processing device to determine the concentration of sand in the well fluid at least in part by determining a ratio of the first magnitudes in the acoustic signature to the second magnitudes in the baseline acoustic-signature.

* * * * *